US006634304B2

(12) United States Patent
Wang

(10) Patent No.: US 6,634,304 B2
(45) Date of Patent: Oct. 21, 2003

(54) COLLAPSIBLE TABLE

(76) Inventor: Rong-Hua Wang, No. 72-3, Hsu Chung Ying, Chung Jung Village, An Ting Hsiang, Tainan Hsien (TW)

( * ) Notice: Subject to any disclaimer, the term of this patent is extended or adjusted under 35 U.S.C. 154(b) by 44 days.

(21) Appl. No.: 09/986,839

(22) Filed: Nov. 13, 2001

(65) Prior Publication Data

US 2003/0089286 A1 May 15, 2003

(51) Int. Cl.[7] ..... A47B 3/00
(52) U.S. Cl. ..... 108/129; 108/115; 248/188.6
(58) Field of Search ..... 108/115, 117, 108/118, 120, 126, 129–131, 151.1, 151.17, 159; 248/166, 188.1, 188.6, 188.91, 436

(56) References Cited

U.S. PATENT DOCUMENTS

| | | | | | |
|---|---|---|---|---|---|
| 960,281 | A | * | 6/1910 | De Moss | 108/129 |
| 1,132,061 | A | * | 3/1915 | Backer | 248/166 |
| 1,369,943 | A | * | 3/1921 | Springer | 108/129 |
| 1,854,248 | A | * | 4/1932 | Cairney | 108/115 |
| 2,077,541 | A | * | 4/1937 | Wieslander | 248/166 |
| 2,412,395 | A | * | 12/1946 | Goosmann | 108/115 |
| 4,341,164 | A | * | 7/1982 | Johnson | 108/115 |
| 4,579,229 | A | * | 4/1986 | Porcaro et al. | 248/166 |
| 5,794,546 | A | * | 8/1998 | Carter | 108/115 |
| 5,865,127 | A | * | 2/1999 | Carter | 108/115 |
| 6,073,894 | A | * | 6/2000 | Chen | 108/115 |
| 6,158,361 | A | * | 12/2000 | Zheng et al. | 108/118 |

FOREIGN PATENT DOCUMENTS

| | | | | |
|---|---|---|---|---|
| GB | 2120539 | * | 12/1983 | |
| JP | 06237823 | * | 8/1994 | 108/129 |

* cited by examiner

*Primary Examiner*—Lanna Mai
*Assistant Examiner*—Hanh V. Tran
(74) *Attorney, Agent, or Firm*—Rosenberg, Klein & Lee

(57) ABSTRACT

A collapsible table is provided. The collapsible table includes a feet unit having two horizontal rods, a plurality of feet each having an upper end pivotally connected to one end of the horizontal rod. Each foot is provided with a position limit ring and a slidable sleeve disposes thereabout. A guide rod is provided pivotally between a horizontal rod and each slidable sleeve. Each position limit ring has a projecting member, and each slidable sleeve has an engage member for engage the projecting member. The position limit rings stop the slidable sleeve upon spreading the feet unit. The slidable sleeve moves the guide rods to force the feet swing down or up during spreading or collapsing. The engagement of the engage members and the projecting members securely retains the feet unit in the spread position.

2 Claims, 5 Drawing Sheets

COLLAPSIBLE TABLE

BACKGROUND OF THE INVENTION

This invention relates to a collapsible table, particularly to one capable to spread and collapse with convenience, and quite stable for use in case of spreading out.

A known convention collapsible table shown in FIG. 8 includes a feet unit 21 collapsible and having four feet 22 of the same length, an upper base 23 combined respectively with an upper end of each foot 22, a bottom cover 24 fitted around the bottom of each foot 22 to contact the ground. A slidable sleeve 25 is fitted movably around each foot 22, two pairs of spreading members 26 consist of a spreading rod 261 respectively and pivotally connected between one slidable sleeve 25 and upper ends of two opposite feet 22 and a connect rod 262 connected between the two opposite slidable sleeve 25. Further, two horizontal upper rods 27 are provided respectively between the upper ends of two pars of feet 22, and a hook 231 is fixed on the upper base 23. Further, a table board 28 consisting of a plurality of narrow boards 281 is provided to be placed on the two upper rods 27 with holes 282 provided on an outermost narrow board 281 engaging the hooks 231 to stabilize the table board on the feet unit 21.

In case that the conventional collapsible table is to be used, the slidable sleeves 25 on the feet 22 are moved with the spreading members 26 spreading from a collapsed condition to a spread condition, with the horizontal rods 27 becoming horizontal between the two upper bases 23, with the table board 28 placed stably on the feet unit 21 by means of the hooks 231 engaging the holes 282. Then the collapsible table is spread completely for use. If the spread table is to be collapsed, first the table board is removed from the feet unit 21, and then pull up one end of the horizontal rods 27 to force it vertically located beside one of the feet 22, and then the connect rods 262 is rotated with the spreading rods 261 as a fulcrum, so the slidable sleeves 25 gradually moving down along the feet 22 until the slidable sleeves 25 reach the bottom cover 24 in the collapsed condition.

Although the conventional collapsible table can be collapsed to become a small capacity for a user to easily carry out for use, it has the following disadvantages.

1. Spreading width of the feet unit have to be slowly adjusted for engaging the holes and the holes for placing the table board on the feet unit, extremely inconvenient for handling for too many points for engaging and for lack of stopping means of the slidable sleeves.
2. The feet unit is liable to sway, swing or be collided by something before it is spread stably for placing the table board for lack of stopping means of the slidable sleeves.
3. The dimensions of the table board is limited, impossible to supply a larger space for use, because the feet are spread and collapsed by means of the spreading members having their length restricted and moving height of the slidable sleeves also restricted.
4. Its structure is limited by the height of the feet, so its spread dimensions are not large. Subsequently, when any edge of the table board receives too large shock, its center of gravity may be unstable, and if worse, the table may fall down.

SUMMARY OF THE INVENTION

The main objective of the invention is to offer a collapsible table mainly including a feet unit consisting of two horizontal rods and four feet respectively having an upper end pivotally connected to one of the two ends of each horizontal rod, spreading members respectively pivotally provided between two feet, each spreading member having plural connect strips pivotally connected with each other. Each foot is possible to be swing up to become parallel to the horizontal rod, having a slidable sleeve fitted movably around and a position limit ring fixed around between the slidable sleeve and the upper end. Further, a guide rod is pivotally connected between each slidable sleeve and the horizontal rod. The spreading members move the slidable sleeves upward along each foot, which is then spread down to become vertical to the horizontal rod, with the slidable sleeves stopped by the position limit rings. Then the collapsible table in the invention is spread out fully for use, with a table board placed on the feet unit, needing no more adjustment.

Another objective of the invention is to offer a collapsible table, in which each position limit ring has a projecting member, and each slidable sleeve has an engage member to engage the projecting member in case of spreading the feet unit, keeping stably the feet unit by means of engagement of the projecting member and the engage member, without possibility of collapsing randomly or falling down.

BRIEF DESCRIPTION OF THE DRAWINGS

This invention will be better understood by referring to the accompanying drawings, wherein.

DETAILED DESCRIPTION OF THE PREFERRED EMBODIMENT

Figure 1:
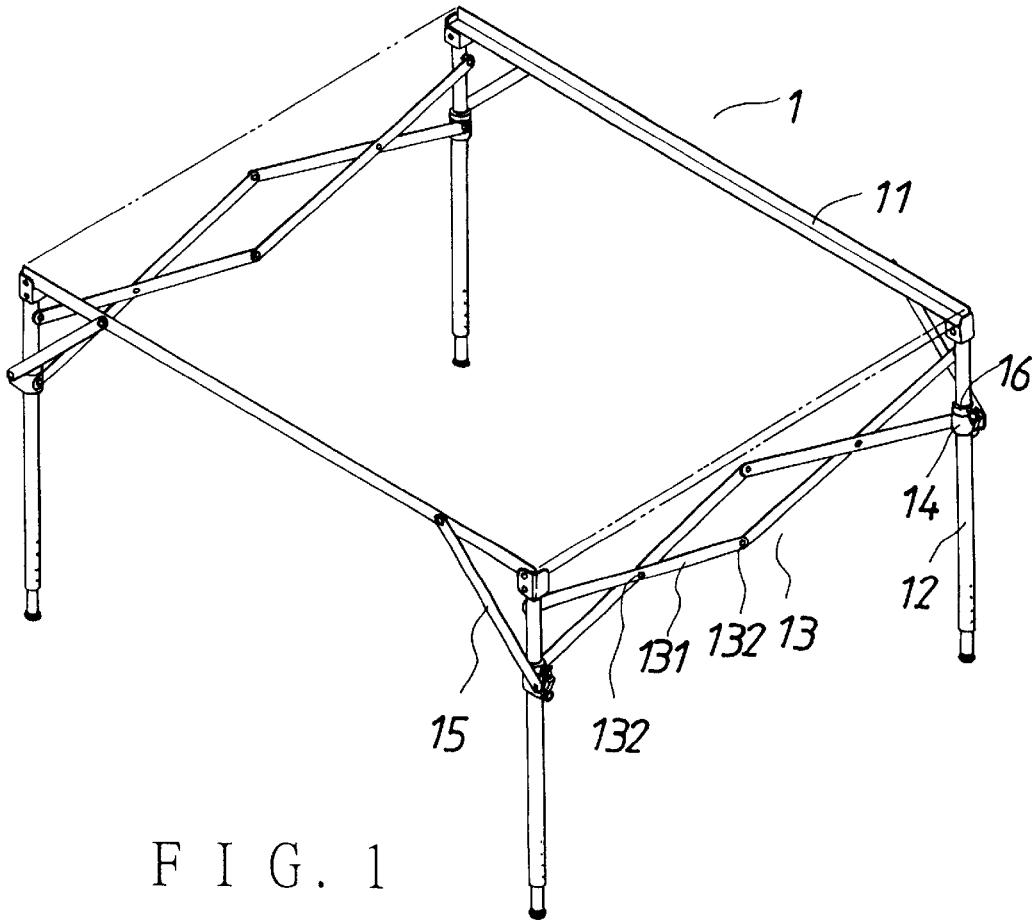
FIG. 1 is a perspective view of a collapsible table in a spread condition of the present invention.

A preferred embodiment of a collapsible table of the present invention, as shown in FIG. 1, includes a feet unit 1 consisting of a horizontal rod 11, and a plurality of feet 12 respectively having an upper end pivotally connected to two ends of the horizontal rod 11. Each foot 12 may be swung up to become parallel to the horizontal rod 11 as shown in FIG. 2, and a spread member 13 is pivotally connected between each pair of feet 12 connected to the two parallel horizontal rods 11.

Figures 3, 5:
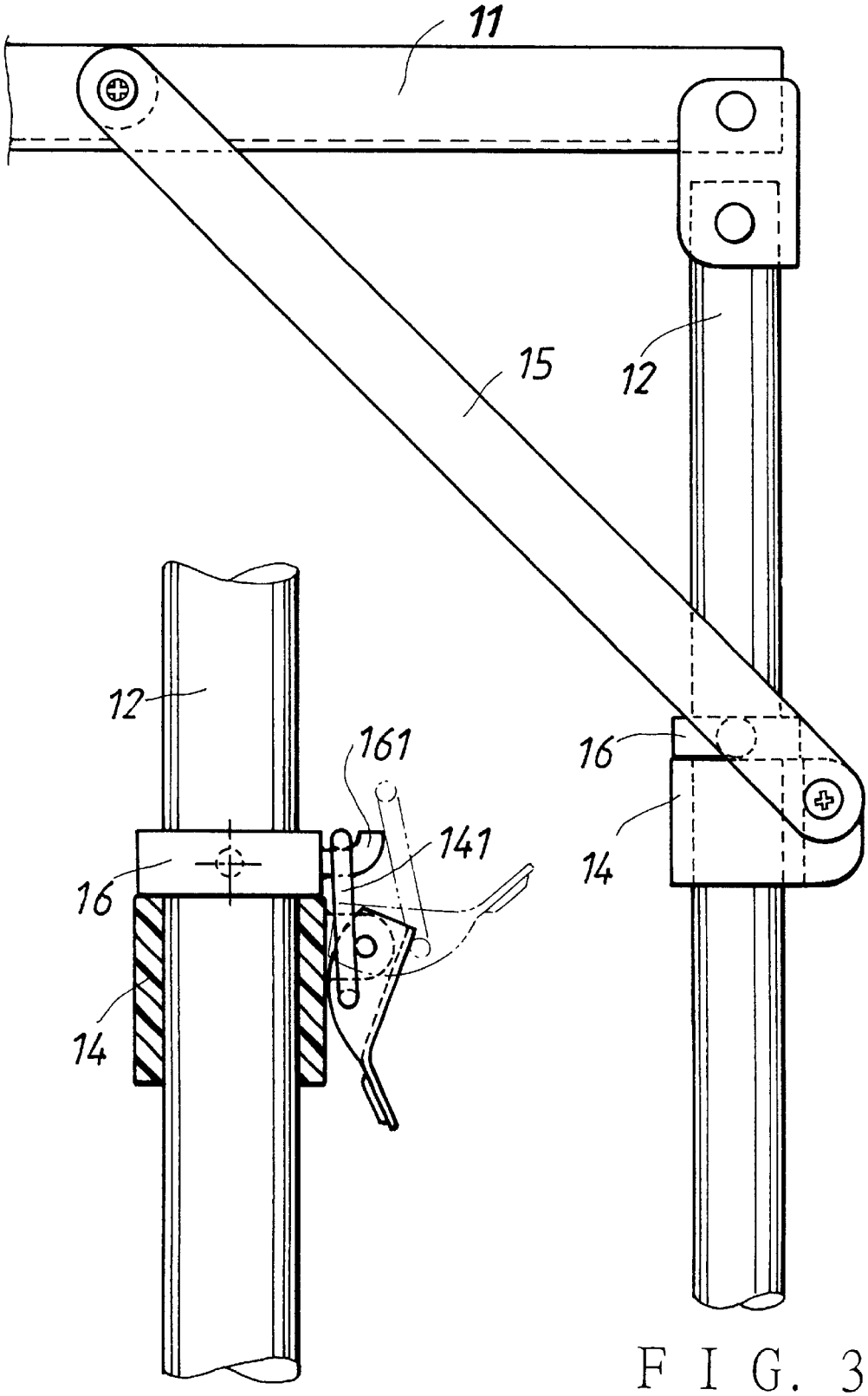
FIG. 3 is a partial magnified view of the collapsible table of the present invention.
FIG. 5 is another partial magnified view of the collapsible table of the present invention.
Figure 4:
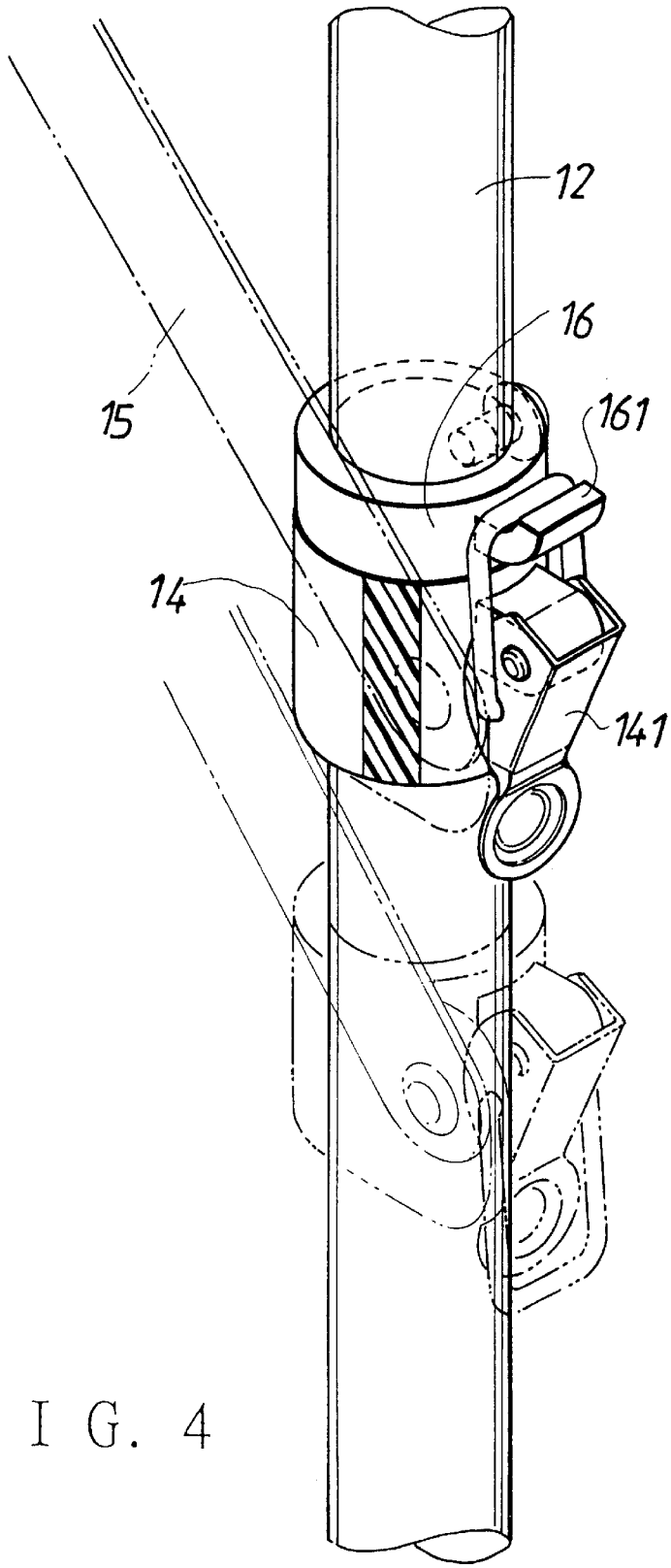
FIG. 4 is a partial magnified perspective view of the collapsible table of the present invention.
Figure 6:
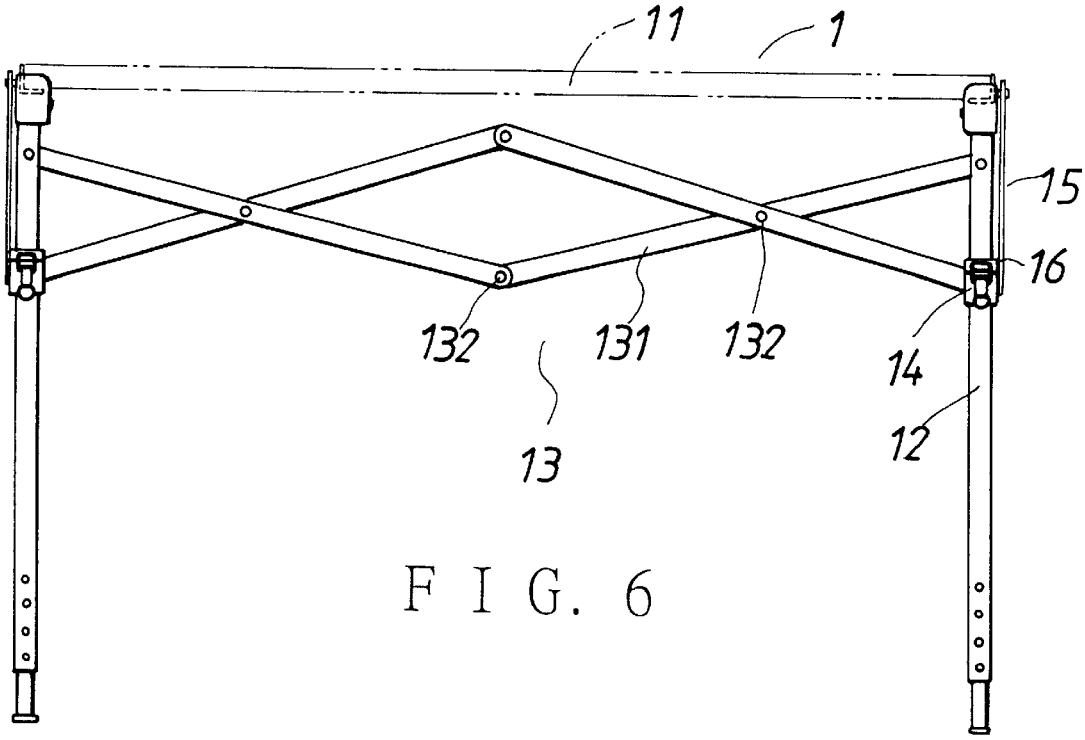
FIG. 6 is a side view of the collapsible table in the spread condition of the present invention.

The spread member 13 includes a plurality of connect strips 131 pivotally connected with each other with a shaft 132, and each connect strip 131 has an upper end pivotally connected with the upper end of each foot 12 and a lower end pivotally connected with a slidable sleeve 14 fitted movably around each foot 12, as shown in FIG. 6. Further, a guide rod 15 is pivotally provided between each slidable sleeve 14 and the horizontal rod as shown in FIG. 3, and a position limit ring 16 is fixed around each foot 12 at a proper point, having a projecting member 161 extending outward. The slidable sleeve 14 has an engage member 141 to engage the projecting member 161 as shown in FIGS. 4 and 5.

Figure 2:
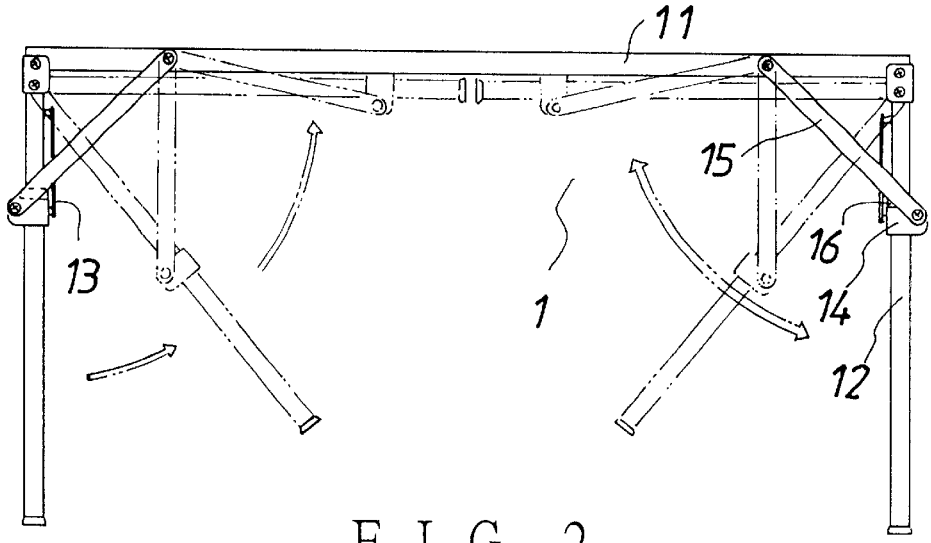
FIG. 2 is a side view of the collapsible table of the present invention, showing how to collapse feet.

When the collapsible table is to be spread for use from a collapsed condition to a spread condition, the two horizontal rods 11 are pulled outward, letting the slidable sleeve 14 of the feet 12 are moved up by the spread members 13, with the slidable sleeves 14 moving up and bringing the guide rods 15 to swing down the feet 12 as shown in FIG. 2 until the slidable sleeves 14 are stopped by the position limit rings 16. Then all the feet 12 are located vertical to the horizontal rods 11 as shown in FIG. 3, kept stable by engage the engage members 141 with the projecting members 161 of the position limit rings 16 as shown in FIGS. 4 and 5. In this way, the feet unit 1 is completely spread out on the ground as shown in FIG. 6.

Figure 7:
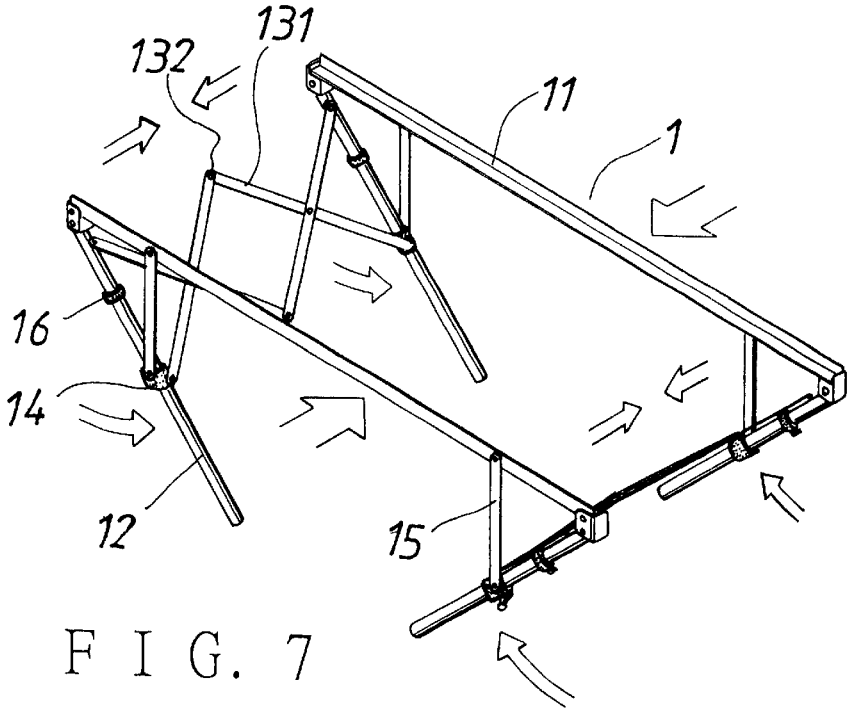
FIG. 7 is a perspective view of the collapsible table being collapsed of the present invention.
Figure 8:
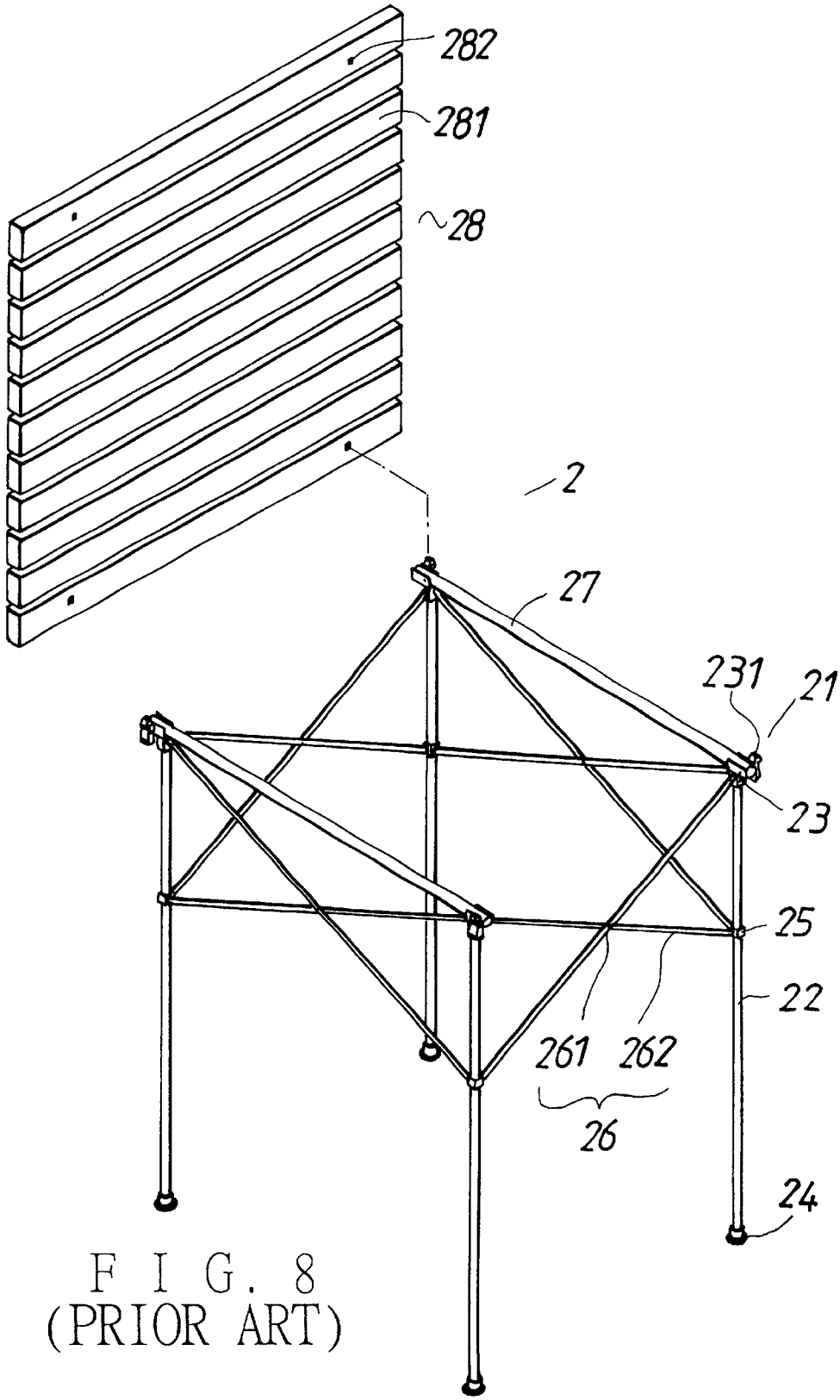
F I G. 8 (PRIOR ART)
FIG. 8 is an exploded perspective view of a known conventional collapsible table.

Conversely, if the feet unit 1 is to be collapsed, disengage the engage members 141 from the projecting members 161, and the two horizontal rods 11 are pushed inward, with the spread members 13 moving down the slidable sleeves 14, and with the guide rods 15 swinging the feet 12 upward to become parallel to the horizontal rods 11. Then the collapsible table is collapsed, having a minimum capacity, convenient to store away and carry out, as shown in FIG. 7.

Compared with the conventional collapsible table, the collapsible table in the invention has the following advantages.

1. The feet unit needs no additional adjusting for its spread width, because the feet have respectively a position limit rings to stop the slidable sleeves after spread out fully for directly placing a table board.
2. The position limit rings respectively have the projecting member and the slidable sleeves respectively have an engage member to engage the projecting member to keep stably the feet respectively without swaying around.
3. It only has two opposite sides pivotally connected with the spread members to spread the feet unit to a rectangular shape of a comparatively large area for a user to use.
4. When it is spread out fully, it has a good stability with the rectangular shape, never fall down because of unstable center of gravity in case of any edge of the table board receiving a shock.
5. Its structure is a device of interactive function, easy and quick to collapse or spread, only having four engaging devices, simple to handle.

What is claimed is:

1. A collapsible table comprising mainly a feet unit, said feet unit consisting of two parallel horizontal rods, a plurality of feet respectively having an upper end pivotally connected to one of two ends of each said horizontal rod, each said foot swinging upward to become parallel to each said horizontal rod, a spread member respectively provided pivotally between two of said feet connected with each said horizontal rod, each spread member having an upper end pivotally connected to the upper end of said foot and a lower end pivotally connected to a slidable sleeve fitted movably around each said foot;

a position limit ring fixed about each said foot, a guide rod provided pivotally between each said horizontal rod and each said slidable sleeve;

said position limit rings being disposed to stop said slidable sleeve upon spreading of said feet unit, said spreading members moving said slidable sleeves up or down in case of spreading or collapsing, said guide rods moving said feet upward to parallel positions to said horizontal rods for collapsing and moving said feet downward to the vertical positions to said horizontal rods for spreading.

2. The collapsible table as claimed in claim 1, wherein each said position limit ring has a projecting member extending outward, and each said slidable sleeve has an engage member to engage each said projecting member said feet unit spreading out to securely retain said feet unit in the spread position.

* * * * *